US006200104B1

(12) United States Patent
Park

(10) Patent No.: US 6,200,104 B1
(45) Date of Patent: Mar. 13, 2001

(54) AUTOMATIC PNEUMATIC PUMP SYSTEM

(76) Inventor: Se Jun Park, 175-20 Sadang-3 Dong, Donjak-Gu, Seoul (KR)

( * ) Notice: Subject to any disclaimer, the term of this patent is extended or adjusted under 35 U.S.C. 154(b) by 0 days.

(21) Appl. No.: 09/448,302

(22) Filed: Nov. 24, 1999

(30) Foreign Application Priority Data

Mar. 18, 1999 (KR) ..... 99-9189

(51) Int. Cl.[7] ..... F04F 1/06; F04F 3/00
(52) U.S. Cl. ..... 417/118; 417/138
(58) Field of Search ..... 417/118, 138, 417/12; 222/61; 137/14; 340/614

(56) References Cited

U.S. PATENT DOCUMENTS 3,915,593 * 10/1975 Chamberlain ..... 417/138
4,521,162 * 6/1985 Parkinson ..... 417/138
4,613,060 * 9/1986 Ulbrich et al. ..... 222/61
5,218,986 * 6/1993 Farwell ..... 137/14
5,749,711 5/1998 Park ..... 417/120
5,859,589 * 1/1999 McGrew, Jr. ..... 340/614
5,897,295 * 4/1999 Rogers et al. ..... 417/12

* cited by examiner

*Primary Examiner*—Teresa Walberg
*Assistant Examiner*—Leonid Fastovsky
(74) *Attorney, Agent, or Firm*—Birch, Stewart, Kolasch & Birch, LLP

(57) ABSTRACT

An automatic pneumatic pump system includes a fluid reservoir, at least one fluid tank connected to the reservoir through an inlet conduit and discharge fluid through an outlet conduit, a pressure sensing unit mounted on each fluid tank and containing a high pressure sensor and a low pressure sensor, a fluid level sensing unit mounted on each fluid tank and containing a high fluid level sensor and a low fluid level sensor, a microprocessor for controlling an operation of the pump system, an air supply conduit connected to the fluid tank to a compressor and the fluid level sensing unit, with the interior of the fluid level sensing unit being configured to communicate with the fluid tank, an air discharge conduit extends from the fluid tank, and an auxiliary air tank connected to both the air supply conduit and the air discharge conduit for automatically cleaning a fluid level sensing unit, improving pumping capacity, and recyclining discharged and compressed air.

5 Claims, 2 Drawing Sheets

AUTOMATIC PNEUMATIC PUMP SYSTEM

BACKGROUND OF THE INVENTION

1. Field of the Invention

The present invention relates to an automatic pneumatic pump for forcibly introducing sludge-laden waste liguid and more particularly, to an automatically operated pneumatic pump system for automatically cleaning a fluid level sensing unit, improving pumping capacity, and recycling discharged and compressed air.

2. Description of the Prior Art

Various types of automatic pneumatic pumps are known in the art. In typical waste water disposal systems, waste water is pumped up and forcibly fed to a filter unit where the sludge in the waste water is filtered off. In order to pump up the sludge-laden waste water, the typical waste water disposal systems are provided with pumps. In the operation of the above systems, the viscous sludge in waste water may stick to the filter unit and thereby cause an operational problem in the filter unit. In this regard the sludge-laden waste water in the above systems has been pumped up by an impeller, piston or vane type pump to be highly pressurized while being fed to the filter unit.

However, the waste water under pressure applies high pressure to the filter unit thus causing damage in the filter unit. In addition, the pump may be overloaded during such a high pressure pumping operation, so the pump regrettably generates operational noises. Another problem of the above pump resides in that the lubrication oil supplied to the drive part of the pump may leak from the pump and go into the waste water.

Accordingly, in order to solve the above problem of such a conventional pneumatic pump the present inventor developed an improvement in such automatic pneumatic pump as disclosed in U.S. Pat. No. 5,749,711 entitled an automatic pneumatic pump including a tank with an inlet and an outlet for forcibly introducing sludge-laden waste liquid such as waste water or industrial wastes into a tank and in turn supplying pressurized air into the tank at a time the tank has been filled with a predetermined amount of liquid thereby forcibly discharging the liquid outside the tank while filtering off the sludge.

However, such a the above pentented pneumatic pump suffers from a numbers of problems. For example since compressed air functions like a piston in the process of pumping fluid, pumped fluid is dispersed to the inside wall of a fluid tank and a fluid level sensing unit. As a result, sludge in the fluid adheres to the fluid level sensing unit, thereby causing a short circuit of the pneumatic pump. The short circuit of the pneumatic pump leads to failure in performing a desired proper operation. In order to eliminate this problem, the fluid level sensing unit of the pneumatic pump is constructed to be disassembled from the pump system, thereby allowing the fluid level sensing unit to be cleaned. Also, according to the pneumatic pump, since the fluid level sensing unit of the pneumatic pump system needs bolts, nuts, sealing members, washers, etc. for the disassembling, the construction of the pump is complex. Additionally, since regular clean up of the fluid level sensing unit is required, for example, 1–2 times a week, maintenance of the pump system is troublesome.

The pneumatic pump fails to operate sometimes. In such a case, when an auxiliary pump does not exist in the system, abrupt breakdowns of the pump cannot be easily dealt with.

When the pressure of the fluid tank is down, compressed air of high pressure is discharged through a solenoid valve, so that a muffler may freeze and thus be damaged due to the fall of temperature and working environment conditions may be diminished due to loud noise. Energy efficiency is low because compressed air is not recycled, but discharged to the surroundings. Additionally, since only air in an air storage tank connected to an air compressor is used to pump the fluid, an operating period of time of the air compressor may be extended, so that a great amount of electric power is consumed to operate the air compressor.

SUMMARY OF THE INVENTION

Accordingly, it is an object of the present invention to provide an automatic pneumatic pump system for cleaning a fluid level sensing unit automatically and improving pumping capacity and recycling discharged compressed air, which eliminates the above problems encountered with conventional pneumatic pump.

Another object of the present invention is to provide an automatic pneumatic pump system, comprising a fluid reservoir, at least one fluid tanks connected to the reservoir through an inlet conduit and discharging fluid through an outlet conduit, a pressure sensing unit mounted on each fluid tank and having a high pressure sensor and a low pressure sensor, a fluid level sensing unit mounted on each fluid tank and having a high fluid level sensor and a low fluid level sensor, a microprocessor controlling an operation of the pump system, an air supply conduit connecting the fluid tank to a compressor, and an air discharge conduit extending from the fluid tank, wherein the air supply conduit is connected to the fluid level sensing unit, with the interior of the fluid level sensing unit being configured to communicate with the fluid tank, and an auxiliary air tank is connected to both the air supply conduit and the air discharge conduit.

A further object of the present invention is to provide an antomatic pneumatic pump system which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skillde in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
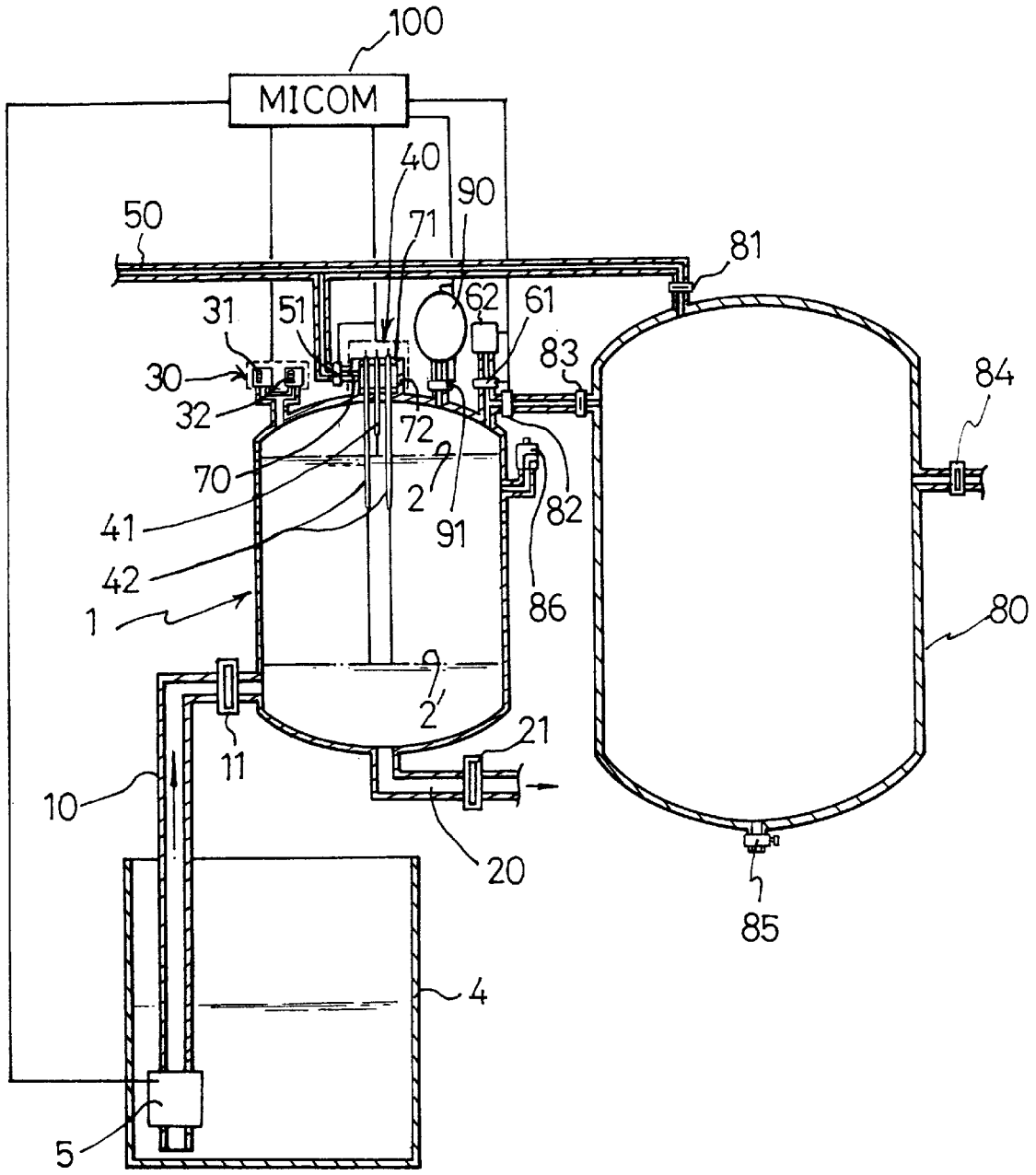
FIG. 1 is a schematic sectioned diagram showing an automatically operated simplex pneumatic pump system according to the first embodiment of this invention.

FIG. 1 is a schematic sectioned diagram showing an automatic pneumatic pump system according to the first embodiment of the present invention. The automatic pneumatic pump system includes a fluid tank 1 having an inlet conduit 10 and an outlet conduit 20 connected to the fluid tank 1, respectively. The inlet conduit 10 has an inlet valve 11 and a pump 5, while the outlet conduit 20 has an outlet valve 21. The inlet conduit 10 is connected to a fluid reservoir 4 at one end there of.

A pressure sensing unit 30 is mounted to the fluid tank 1, the pressure sensing unit 30 containing of a high pressure sensor 31 and a low pressure sensor 32 for sensing pressures in the fluid tank 1. A fluid level sensing unit 40 is mounted to the fluid tank 1 and contains a high fluid level sensor 41 and a low fluid level sensor 42 for sensing the fluid levels in the fluid tank 1.

A microprocessor, micom, 100 is provided to control the system according to output signals from the pressure sensing unit 30 and the fluid level sensing unit 40.

An air supply conduit 50 is connected to a compressor (not shown) and the fluid tank 1 to each other, the air supply conduit 50 having a first solenoid valve 51. The first solenoid valve 51 is operated according to a control signal from the microprocessor 100 for controlling air supply from the compressor to the fluid tank 1.

An air discharge conduit 60 is connected to the fluid tank 1, the air discharge conduit 60 having a second solenoid valve 61 and a muffler 62. The air supply conduit 50 is connected to the sidewall 72 of the housing 71 of the fluid level sensing unit 40, and the interior of the housing 71 is configured to communicate with the interior of the fluid tank 1. The conduit 50 communicates with the interior of the housing 71 through an air inlet hole 70.

According to further feature of the present invention, an auxiliary air tank 80 is provided. The auxiliary air tank 80 is connected to the air supply conduit 50 with a first check valve 81 mounted to the pipe extending from the auxiliary air tank 80 to the air supply conduit 50. Also, the auxiliary air tank 80 is connected to the air discharge conduit 60 with a third solenoid valve 82 and a second check valve 83 mounted to the pipe extending from the auxiliary air tank 80 to the air discharge conduit 60. The auxiliary air tank 80 additionally has a third check valve 84 and a drain valve 85. A vacuum pump 90 is connected to the fluid tank 1 with a fourth solenoid valve 91 mounted to the pipe extending from vacuum pump 90 to the fluid tank 1.

Figure 2:
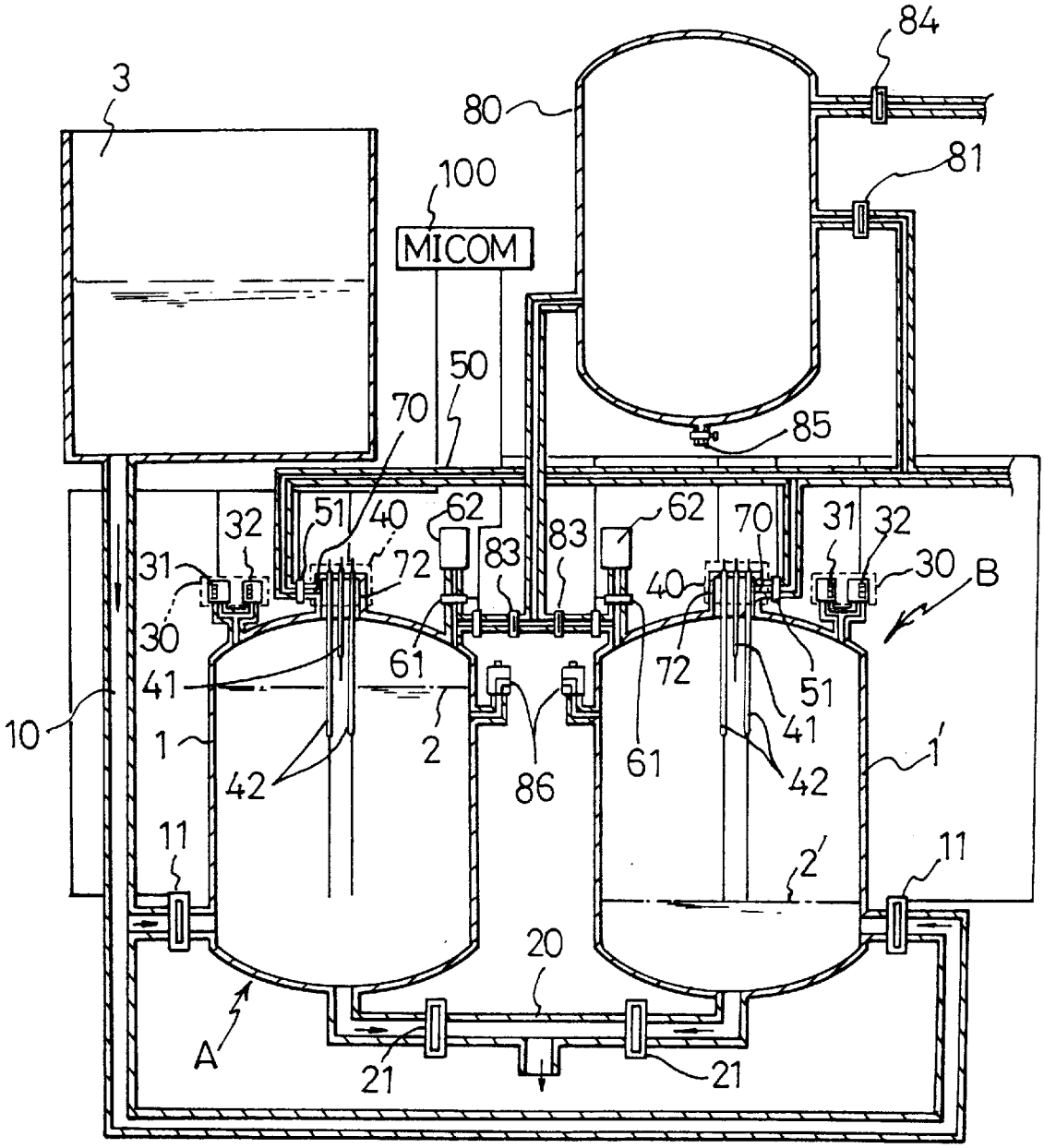
FIG. 2 is a schematic sectioned diagram showing an automatically operated duplex pneumatic pump system according to the second embodiment.

FIG. 2 is a schematic sectioned diagram showing an automatic pneumatic pump system according to the second embodiment of the present invention.

The automatic pneumatic pump system is similar to the automatic pneumatic pump system having the tank 1 above described with the exceptions that two fluid tanks 1 and 1' are provided, a fluid reservoir 3 is positioned above the fluid tanks 1 and 1', and modification due to provision of two fluid tanks 1 and 1' and the position of the fluid reservoir 3 is included.

An inlet conduit 10 is connected to the two fluid tanks 1 and 1', the inlet conduit 10 having an inlet valve 11 for the fluid tank 1 and an inlet valve 11 for the fluid tank 1' and being connected to the fluid reservoir 3 at its one end. An outlet conduit 20 is also connected to the two fluid tanks 1 and 1', the outlet conduit 20 having two outlet valves 21 for the fluid tanks 1 and 1'.

Two pressure sensing units 30 are respectively mounted to the fluid tanks 1 and 1', and also two fluid level sensing units 40 are respectively mounted to the fluid tanks 1 and 1'. An air supply conduit 50 is connected to the sensing units 40, the air supply conduit 50 having a first solenoid valve 51 for the fluid tank 1 and a first solenoid valve 51' for the fluid tank 1'. Two air discharge conduits 60 and 60' are respectively connected to the fluid tanks 1 and 1', the air discharge conduits 60 and 60' individually having a muffler 62.

An auxiliary air tank 80 is connected to the pipe connecting the air discharge conduits 60 to each other, with two second check valves 83 mounted to the pipe.

The operation of the present invention will be described hereinafter. This description is mainly accomplished with regard to the pneumatic pump system having the fluid tank 1.

When the outlet valve 21 and the first solenoid valve 51 are closed and the second, third and fourth solenoid valves 61, 82 and 91 are opened, fluid is supplied from the fluid reservoir 4 to the fluid tank 1 until fluid level reaches a high fluid level of the fluid tank 1. The fluid supply in the simplex pneumatic pump system is accomplished by the pump 1 or the vacuum pump 90, while the fluid supply in the duplex pneumatic pump system is accomplished by the operation of the weight of fluid contained in the fluid reservoir 3.

When the high fluid level sensor 41 senses arrival of the fluid at the high fluid level, the microprocessor outputs a control signal to the first solenoid valve 51. In response to the signal, the first solenoid valve 51 is opened, thus allowing air to flow into the fluid tank 1 through the air supply conduit 50 and fluid level sensing unit 40.

When the high pressure sensor 31 of the pressure sensing unit 30 senses the high pressure, the microprocessor outputs a control signal to the outlet valve 21 and the second, third and fourth solenoid valves 61, 82 and 91. In response to the signal, the outlet valve 21 is closed and the second, third and fourth solenoid valves 61, 82 and 91 are opened, thus allowing fluid to flow out of the fluid tank 1 through the outlet conduit 20 while maintaining the high pressure in the fluid tank 1.

When the low fluid level sensor 42 senses arrival of the fluid at the low fluid level, the microprocessor outputs a control signal to the outlet valve 21, the first solenoid valve 51 and the third solenoid valve 82. In response to the signal, the outlet valve 21 and the first solenoid valve 51 are closed and the third solenoid valve 82 is opened, thus allowing air in the fluid tank 1 to flow into the auxiliary air tank 80 through the second check valve 83. The second check valve 83 is opened when the pressure in the fluid tank 1 is higher than the pressure in the auxiliary air tank 80, while the second check valve 83 is not opened when the pressure in the auxiliary air tank 80 is higher than the pressure in the fluid tank 1.

When the second solenoid valve 61 is opened after storage of the compressed air in the auxiliary air tank 80, the remaining compressed air is discharged into the atmosphere through the air discharge conduit 60 and the muffler 62 until the low pressure sensor 32 of the pressure sensing unit 30 senses the low pressure in the fluid tank 1. Since the compressed air of high pressure passes through the pressure sensing unit 30, sludge and moisture adhering to the pressure sensing unit 30 are removed, thereby preventing the pump from failing due to the occurrence of a short circuit.

The storage of the compressed air in the auxiliary air tank 80 is described in more detail hereinafter. When the volume of the fluid tank 1 is 500 liters, the pressure of the compressed air is 5 kPa and the compressed air is discharged into the atmosphere through the second solenoid valve 61, the pressure in the fluid tank 1 becomes zero in 4 seconds. Therefore, when the second solenoid valve 61 is closed and the third solenoid valve 82 is opened in 2 seconds, 50–70% of the compressed air is discharged into the auxiliary air tank 80. Incidentally, since the period of time to be discharged depends upon the diameter of the pipe extending from the fluid tank 1 to the auxiliary air tank 30, the period of time is controlled by regulating the diameter of the pipe as occasion demands.

In more detail, the fluid supply into the fluid tank 1 is described in the following. When the low pressure sensor 32 of the pressure sensing unit 30 senses the low pressure in the tank 1, the fluid in the fluid reservoir 4 should be supplied into the tank 1.

The fluid supplying method is classified into two types pursuant to the embodiments. First, according to the simplex pneumatic pump, the fluid supply is accomplished by the pump 1 or the vacuum pump 90. Second, according to the pneumatic pump having a pair of tanks 1 and 1', the fluid supply is accomplished by the weight of fluid contained in the fluid reservoir 4. In case that the fluid reservoir 4 is positioned below the fluid tank 1 as shown in FIG. 1, the fluid supply is accomplished by the pump 1 or the vacuum pump 90.

The fluid supply by the pump 90 is described firstly. When the low pressure sensor 32 of the pressure sensing unit 30 senses the low pressure, the microprocessor outputs control signals to the pump 5, the inlet valve 11, the outlet valve 21, the second solenoid valve 61, the third solenoid valve 82 and the fourth solenoid valve 91. In response to the signals, the outlet valve 21 and the fourth solenoid valve 91 are closed, the second solenoid valve 61 and the third solenoid valve 82 are opened, and the pump 5 is operated. As a result, the fluid in the fluid reservoir 4 is suctioned into the high fluid level.

The fluid supply by the vacuum pump 90 is described secondly. When the low pressure sensor 32 of the pressure sensing unit 30 senses the low pressure, the microprocessor outputs control signals to the vacuum pump 90, the inlet valve 11, the outlet valve 21, the second solenoid valve 61, the third solenoid valve 82 and the fourth solenoid valve 91. In response to the signals, the outlet valve 21, the second solenoid valve 61 and the third solenoid valve 82 are closed, the inlet valve 11 and the fourth solenoid valve 91 are opened, and the vacuum pump 90 is operated. As a result, the fluid tank 1 is vacuumized, thereby suctioning the fluid in the fluid reservoir 4 into the high fluid level. In case that the fluid reservoir 4 is positioned above the fluid tanks 1 and 1' as shown in FIG. 2, the fluid supply is accomplished by the operation of the weight of fluid contained in the fluid reservoir 4.

In such a case, the suction device, such as a pump or a vacuum pump, is not necessary for the fluid supply from the fluid reservoir 3 to the fluid tank 1. That is, pursuant to the law of gravity, the fluid in the fluid reservoir 3 spontaneously flows into the fluid tanks 1 and 1'. At this time, the inlet valve 11 is opened according to the control signal from the microprocessor.

On the other hand, the stored compressed air in the auxiliary air tank 80 may be used to operate a variety of air valves (not shown), the air valves being mounted to this pneumatic pump system for other purposes. Incidentally, since the air valves should be operated by low pressure air, it eliminates the use of a pressure reducer to utilize the stored compressed air for operating the air valves. Also, the stored compressed air is used to operate a variety of pneumatic machines. There is no problem in using the stored compressed air because air of less than 3 kPa is enough to operate the machines.

Additionally, the stored compressed air may be returned to the air supply conduit 50. On occasion, the pressure of the compressed air supplied through the air supply conduit 50 decreases abruptly because the pneumatic pump system consumes more than 500 liters of air every stroke. At this time, since the air pressure in the air supply conduit 50 is lower than the air pressure in the auxiliary air tank 80, the stored compressed air in the auxiliary air tank 80 may be spontaneously returned to the air supply conduit 50 through the first check valve 81. The returned air is added to the compressed air in the air supply conduit 50, thereby preventing pressure drops and reducing the time period to reach the desired pressure. Consequently, stops of operation are prevented and operational efficiency is improved. Incidentally, when 2–3 auxiliary air tanks are employed so as to store the used compressed air, more 70%, of used compressed air is recycled, thereby maximizing energy efficiency.

The automatic pneumatic pump system of the present invention is used in conjunction with a hydroextractor. In the hydroextractor such as a filter press, when the sludge is not accumulated, low pressure air is applied to operate the machine. Therefore, the stored compressed air may be used to operate the hydroextractor. On the other hand, when the sludge is accumulated and, therefore, the water content of the sludge cake is less than 50%, high pressure air is used to dehydrate the sludge.

According to the present invention, the following advantages are obtained. Since inconvenience to disassemble the fluid level sensing unit 40 and to clean it is eliminated, maintenance of the system becomes easy. Since the vacuum pump 90 is additionally employed, pumping capacity is improved. Since used compressed air is recycled, energy efficiency is maximized, the life span of a muffler is extended and noise due to discharged air is reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic pneumatic pump system, comprising:

a fluid reservoir;

at least fluid tank connected to said reservoir through an inlet conduit and discharging fluid through an outlet conduit;

a pressure sensing unit mounted on each fluid tank and containing a high pressure sensor and a low pressure sensor;

a fluid level sensing unit mounted on each fluid tank and containing a high fluid level sensor and a low fluid level sensor;

a microprocessor controlling an operation of the system;

an air supply conduit connecting the fluid tank to a compressor, said air supply conduit connected to said fluid level sensing unit, with the interior of said fluid level sensing unit being configured to communicate with said fluid tank; and an auxiliary air tank connected to both said air supply conduit and said air discharge conduit; and an air discharge conduit extending from the fluid tank, whereby the automatic pneumatic pump system effectively and automatically cleans the fluid level sensing unit improves pupming capacity, and recyclines dischanged and compressed air.

2. The pneumatic pump system of claim 1, further comprising a vacuum pump connected to said fluid tank, with a solenoid valve mounted to a pipe extending from said vacuum pump to said fluid tank.

3. The pnuematic pump system of claim 1, wherein said air supply conduit in conected to the sidewall of a housing of said fluid level sensing unit and communicates with the interior of said housing throgh an air inlet hole.

4. The pneumatic pump system of claim 1, wherein the number of said fluid tanks is two, with said reservoir being positioned above the two fluid tanks, said two fluid tanks being commonly connected to said inlet conduit and being commonly connected to said outlet conduit, said air supply conduit being commonly connected to the fluid level sensing units of the two fluid tanks, said air discharge conduit being connected to each of the two fluid tanks, and said auxiliary air tank being commonly connected to the air discharge conduits.

5. The pneumatic pump system of claim 4, wherein said air supply conduit is connected to the sidewall of a housing of said fluid level sensing unit and communicates with the interior of said housing through an air inlet hole.

* * * * *